US006520672B1

(12) United States Patent
Whitney

(10) Patent No.: US 6,520,672 B1
(45) Date of Patent: Feb. 18, 2003

(54) PAINT CLEANUP KIT

(76) Inventor: Mike Whitney, 81 County Rd. 306, Elk Creek, CA (US) 95939

( * ) Notice: Subject to any disclaimer, the term of this patent is extended or adjusted under 35 U.S.C. 154(b) by 5 days.

(21) Appl. No.: 09/621,079

(22) Filed: Jul. 21, 2000

Related U.S. Application Data

(63) Continuation-in-part of application No. 09/273,473, filed on Mar. 22, 1999, now abandoned.

(51) Int. Cl.[7] ..... A46B 17/06

(52) U.S. Cl. ..... 366/129; 366/285; 366/605; 134/149; 134/900

(58) Field of Search ..... 134/149, 900; 366/129, 343, 605, 331, 285, 309, 311, 308, 325.93; 206/219

(56) References Cited

U.S. PATENT DOCUMENTS

| | | | | | |
|---|---|---|---|---|---|
| 1,574,104 | A | * | 2/1926 | Miles | 366/311 |
| 2,542,491 | A | | 2/1951 | Engel | |
| 2,711,748 | A | * | 6/1955 | Barsness | 134/149 |
| 2,931,661 | A | | 4/1960 | Harris | |
| 2,965,111 | A | * | 12/1960 | Feigelman | 134/135 |
| 3,081,473 | A | | 3/1963 | Wells | |
| 3,085,583 | A | * | 4/1963 | Siek | 134/109 |
| 3,252,174 | A | * | 5/1966 | Schoepske, Jr. | 134/149 |
| 3,399,463 | A | * | 9/1968 | Stott | 134/149 |
| 3,421,527 | A | * | 1/1969 | Dettman | 134/138 |
| 3,436,264 | A | * | 4/1969 | Allen | 134/149 |
| 3,460,268 | A | | 8/1969 | Greathouse | |
| 3,696,457 | A | * | 10/1972 | Hand | 134/149 |
| 3,925,908 | A | | 12/1975 | Dunn | |
| 4,332,067 | A | * | 6/1982 | Pearce | 15/230.11 |
| 4,352,477 | A | * | 10/1982 | Garrett et al. | 15/257.01 |
| 4,545,395 | A | | 10/1985 | Kolb | |
| 4,733,679 | A | | 3/1988 | Dolcater | |
| 5,185,938 | A | * | 2/1993 | Hutt | 15/246 |
| 5,326,167 | A | * | 7/1994 | Ware et al. | 366/247 |
| 5,539,948 | A | | 7/1996 | McCauley et al. | |
| 5,630,284 | A | * | 5/1997 | Huang | 34/58 |
| 5,984,518 | A | | 11/1999 | King et al. | |
| 6,012,473 | A | | 1/2000 | Koyama | |
| 6,038,787 | A | * | 3/2000 | Dean et al. | 34/312 |

FOREIGN PATENT DOCUMENTS

GB 2 219 732 A * 12/1989

* cited by examiner

*Primary Examiner*—Charles E. Cooley
*Assistant Examiner*—David Sorkin

(57) ABSTRACT

A kit of painting accessories enabling a user to clean paint rollers and brushes by spinning them with a hand drill, and to mix paint utilizing a hand drill. The kit includes an element for grasping paint brushes, a paint roller holder, a drive adapter enabling the aforementioned kit components to be mounted on a hand drill and rotatably driven thereby, and a paint mixer having a shaft insertable into the chuck of the hand drill. The paddle of the paint mixer can be adjusted between two positions selectively enabling the mixer to mix paint and to receive a paint roller for cleaning by spinning.

8 Claims, 3 Drawing Sheets

PAINT CLEANUP KIT

REFERENCE TO RELATED APPLICATION

This is a Continuation-In-Part of Ser. No. 09/273,473, filed Mar. 22, 1999 now abandoned.

BACKGROUND OF THE INVENTION

1. Field of the Invention

The present invention relates to painting accessories, and more particularly to a kit providing accessories which assist in diverse operations of hand painting. The components of the kit assist in cleaning painting rollers and hand brushes, and in stirring paint. The kit may be employed both by professional painters in new construction and maintenance, and by amateur painters such as homeowners and hobbyists undertaking similar tasks.

2. Description of the Prior Art

Painting by hand, particularly building walls and partitions and other large objects, requires different tools such as brushes and rollers for applying paint to surfaces being painted. When a painter interrupts his or her work for any reason, it is a wise precaution to clean brushes and rollers so that paint will not dry and cake thereon. Frequently this is done by wiping brushes and even rollers on a convenient surface, such as the inner flange of a paint can. However, wiping leaves a considerable amount of paint on the brush or roller. The prior art has taken note of the problem of efficient cleaning paint brushes and rollers, and has proposed apparatus to expedite cleaning.

One of the areas addressed by the prior art is that of cleaning cylindrical paint rollers. A painting roller can be cleaned by rotating the same about its longitudinal axis. Hand drills can be utilized to impart rotation. This approach is seen in U.S. Pat. No. 3,925,908, issued to Kirkley J. Dunn on Dec. 16, 1975. Dunn shows a device adapted to rotate both brushes and paint rollers by connecting each to a hand drill. By contrast, the present invention has two separate components for cleaning rollers and brushes. The novel kit also includes a paint mixer not seen in Dunn.

U.S. Pat. No. 6,012,473, issued to Takehiko Koyama on Jan. 11, 2000, illustrates a device capable of both cleaning a paint roller and also mixing paint. By contrast, the present invention has two separate components for cleaning rollers and mixing paint. The novel kit also includes a brush cleaning device not shown in Koyama.

U.S. Pat. No. 3,460,268, issued to Carl F. Greathouse on Aug. 12, 1969, shows a frame adapted to grip a paint brush for connection to a hand drill so that the paint brush can be cleaned by rotating it. The novel kit contains a flexible metallic receptacle which grips the handle of a paint brush. Greathouse lacks the flexing metallic receptacle of the novel kit, as well as a paint mixer and apparatus for cleaning a paint roller.

U.S. Pat. No. 2,931,661, issued to Joseph N. Harris on Apr. 5, 1960, shows apparatus for grasping a paint brush and attaching the same to a hand drill for cleaning. A corresponding attachment of the novel kit has a spring operated structure for engaging a brush handle, whereas Harris provides a continuous elastomeric skirt. Harris does not show the paint mixer and roller cleaner provided in the novel kit.

None of the above inventions and patents, taken either singly or in combination, is seen to describe the instant invention as claimed.

SUMMARY OF THE INVENTION

The present invention sets forth a kit of implements which enable the user to mix paint and to clean conventional paint brushes and paint rollers utilizing a hand drill. The implements grasping the paint roller and the mixer share a common mounting arrangement utilizing a shaft which is inserted into the hand drill. The implement for grasping brushes has a metallic element which constricts resiliently over the handle of the brush. Thus the novel implements engage and cooperate with brushes and rollers not originally configured to cooperate with attachments for a hand drill.

Optionally, two implements of different diameters are provided, for cleaning standard and small paint rollers. In another option, the paint mixer is selectively adjustable to be configured to mix paint and to support a paint roller for cleaning, thereby being capable of providing two functions. In a further option, implements for cleaning paint rollers are provided in solid cylindrical form and in the form of a cage.

Accordingly, it is one object of the invention to provide a kit of implements for assisting a person to mix paint and to clean paint rollers and brushes.

It is another object of the invention that the implements engage a hand drill for imparting rotation to a paint mixer, paint brushes, and paint rollers.

It is a further object of the invention that the kit of implements engage paint brushes and rollers of different dimensions.

Still another object of the invention is that the kit of implements cooperate with standard painting tools not configured to cooperate with the novel implements.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
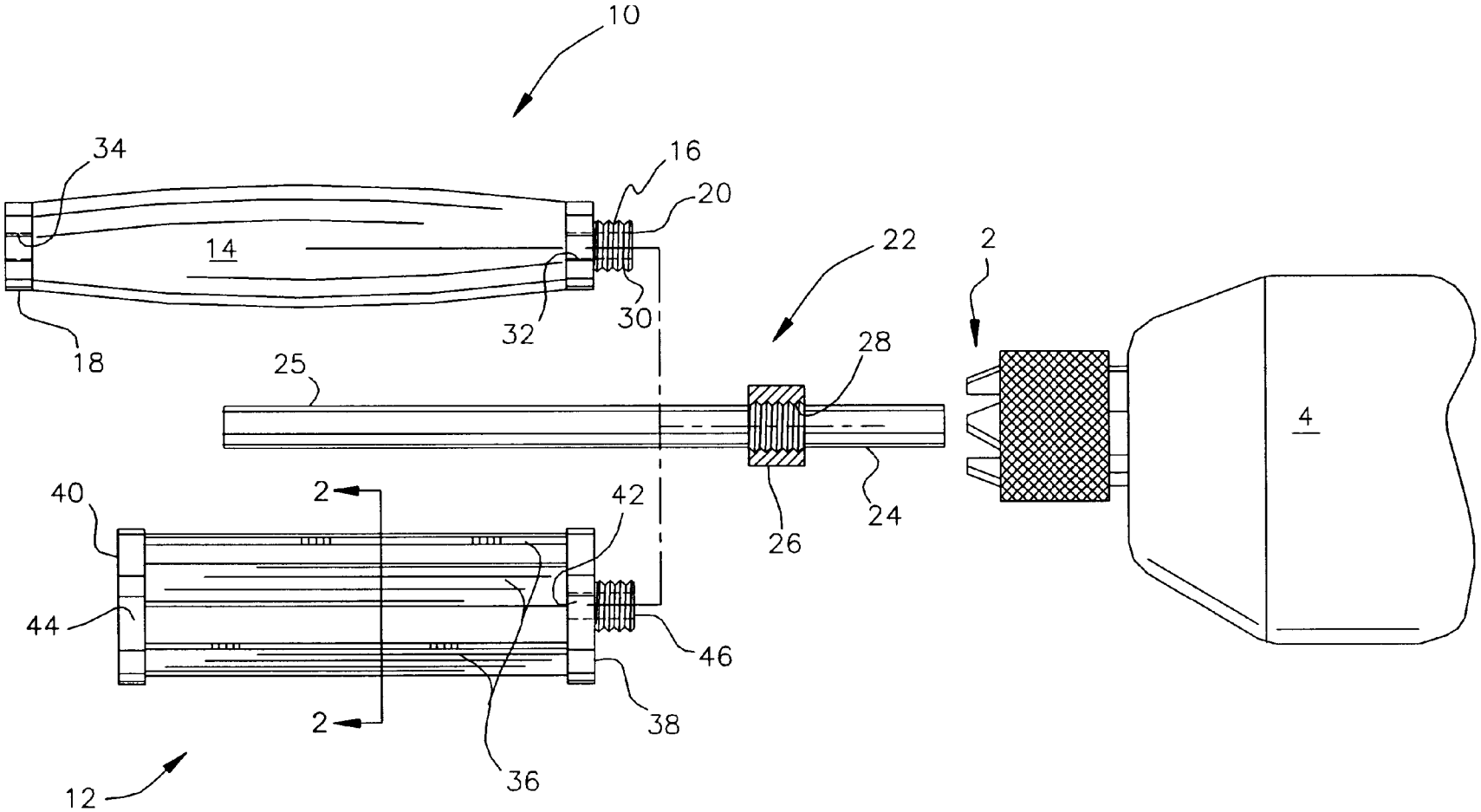
FIG. 1 is an environmental, side elevational view of one embodiment of three painting accessories of the kit of the invention.

FIG. 1 of the drawings shows two implements of a kit of implements for mixing paint and cleaning paint rollers (not shown). The implements are a first roller support member 10 dimensioned and configured to occupy the hollow center of a paint roller, and a mixer 12. Roller support member 10 is barrel shaped, and has a continuous outer lateral surface 14, a first end cap 16, a second end cap 18, and a short threaded shaft 20. Shaft 20 is hollow. Member 10 is inserted into the hollow center of a paint roller (not shown) and caused to spin rapidly with the paint roller generally centered about surface 14. This is accomplished by connecting member 10 to a drive element 22 having an elongate shaft 24. Shaft 24 is dimensioned and configured to be engageable with the chuck 2 of an electrically operated hand drill 4. Threaded shaft 20 of member 10 is threaded into the hole of a nut 26 welded or otherwise securely fixed to shaft 24. The hole bears threads 28 which are matingly compatible with threads 30 of shaft 24. Nut 26 therefore serves as a connector enabling member 10 to be threaded to drive element 22. Element 22 serves a further purpose as directly supporting a very small roller (not shown) dimensioned and configured to fit onto extension 25.

Shaft 24 is secured in chuck 2 of hand drill 4. Shaft 24 has an extension 25 characterized by having a diameter small enough to pass through the hollow center of shaft 20 of member 10. Extension 25 is passed through an opening 32 formed in end cap 16 of member 10 and into an opening 34 formed in end cap 18. This arrangement enables member 10 to be threaded to nut 26, while stabilizing member 10 relative to shaft 24 when the latter is rotated by hand drill 4.

Figure 2:
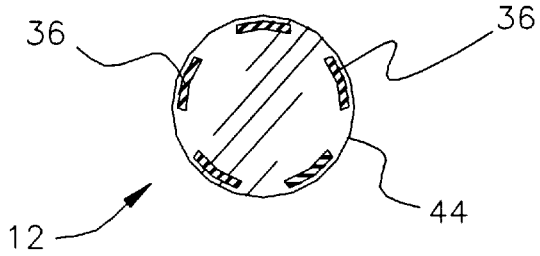
FIG. 2 is an end, cross sectional view taken along line 2—2 of FIG. 1.

Mixer 12 differs in purpose and configuration from member 10, but connects to drive element 22 in a similar manner. Mixer 12 comprises an open cage having paddles in the form of slats 36 oriented longitudinally relative to the axis of rotation of mixer 12 when mixer 12 is connected to drive element 22 and drive element 22 is rotated by hand drill 4. Arrangement of slats 36 is better understood by referring to FIG. 2. End caps 38, 40 of mixer 12 have respective openings 42, 44 which correspond to openings 32, 34 of member 10. Extension 25 is passed through opening 42 and comes to occupy opening 44 when short shaft 46 is threaded to nut 26 of drive element 22.

Either or both of member 10 and mixer 12 may be provided as components of the novel kit, each having its own attachment element 20 or 46 which is removably attachable to connector (provided by nut 26) of drive element 22. If both are provided, then they are preferably of different diameters so that they can be utilized to clean paint rollers of different dimensions. They may be similar in configuration and proportions, if desired, differing only in dimensions.

Figure 3:
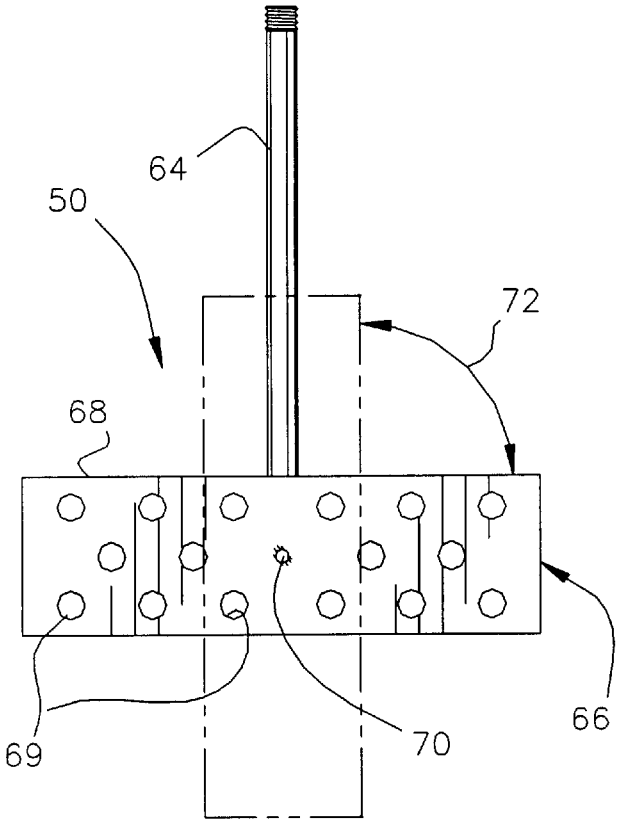
FIG. 3 is a side elevational view of an accessory device of the invention.

Referring now to FIG. 3, optional paint mixer 50 has an elongate base shaft 64 and a mixing element 66 anchored at one end of base shaft 64. Mixing element 66 comprises a member 68 having perforations 69 and a pin or rivet 70 enabling member 68 to rotate relative to base shaft 64 in a direction indicated by arrow 72. Rivet 70 enables member 68 to be mounted on base shaft 64 selectively in a first position longitudinally aligned relative to base shaft 64, this being shown in broken lines in FIG. 3, and in a second position perpendicularly aligned relative to base shaft 64. The second position is shown in solid lines. In the second position, member 68 serves as a paint mixer. In the first position, mixing element 66 may be employed as a support for holding a paint roller on hand drill 4 so that the paint roller can be spun and cleaned utilizing hand drill 4.

It should be noted that extension 25 can receive thereon a very small roller cover. Extension 25, member 10, and mixing element 66 are dimensioned and configured to engage paint rollers of different diameters. The kit therefore provides the ability to clean diverse paint rollers while including a minimum of components.

Figure 4:
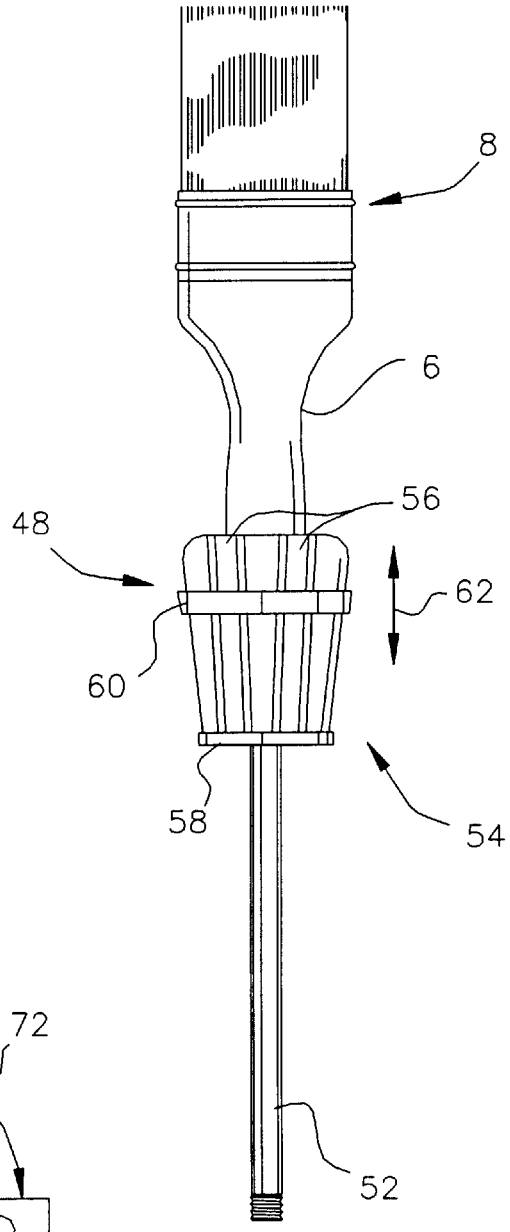
FIG. 4 is an environmental, side elevational view of a second accessory device of the invention.

FIG. 4 shows a paint brush holder 48 and still another mixer 50. Brush holder 48 has an elongate shaft 52 engageable with chuck 2 of hand drill 4 by insertion thereinto. A resilient grasping member 54 is disposed to close resiliently over handle 6 of a paint brush 8. Member 54 may be of any type which constricts about handle 6. In the examplary construction shown in FIG. 4, member 54 comprises fingers 56 anchored at a base 58. A ring 60 slides over fingers 56 in directions indicated by arrow 62. When moved upwardly, as shown in the depiction of FIG. 4, ring 60 closes fingers 56 over handle 6 of brush 8. Fingers 56 are mounted on base 58 and configured to be able to close over brush handles of different dimensions.

It will be seen in FIG. 4 that the free end of shaft 52 is threaded, as is shaft 64 of FIG. 3. This feature enables respective member 54 and mixer 50 to thread to nut 26 of element 22, thereby enabling member 54 and mixer 50 to be driven by element 22 as well as by insertion into and direct engagement with chuck 2. Preferably, all attachments are threaded to enable driving both by element 22 as well as directly from drill 4.

Figure 5:
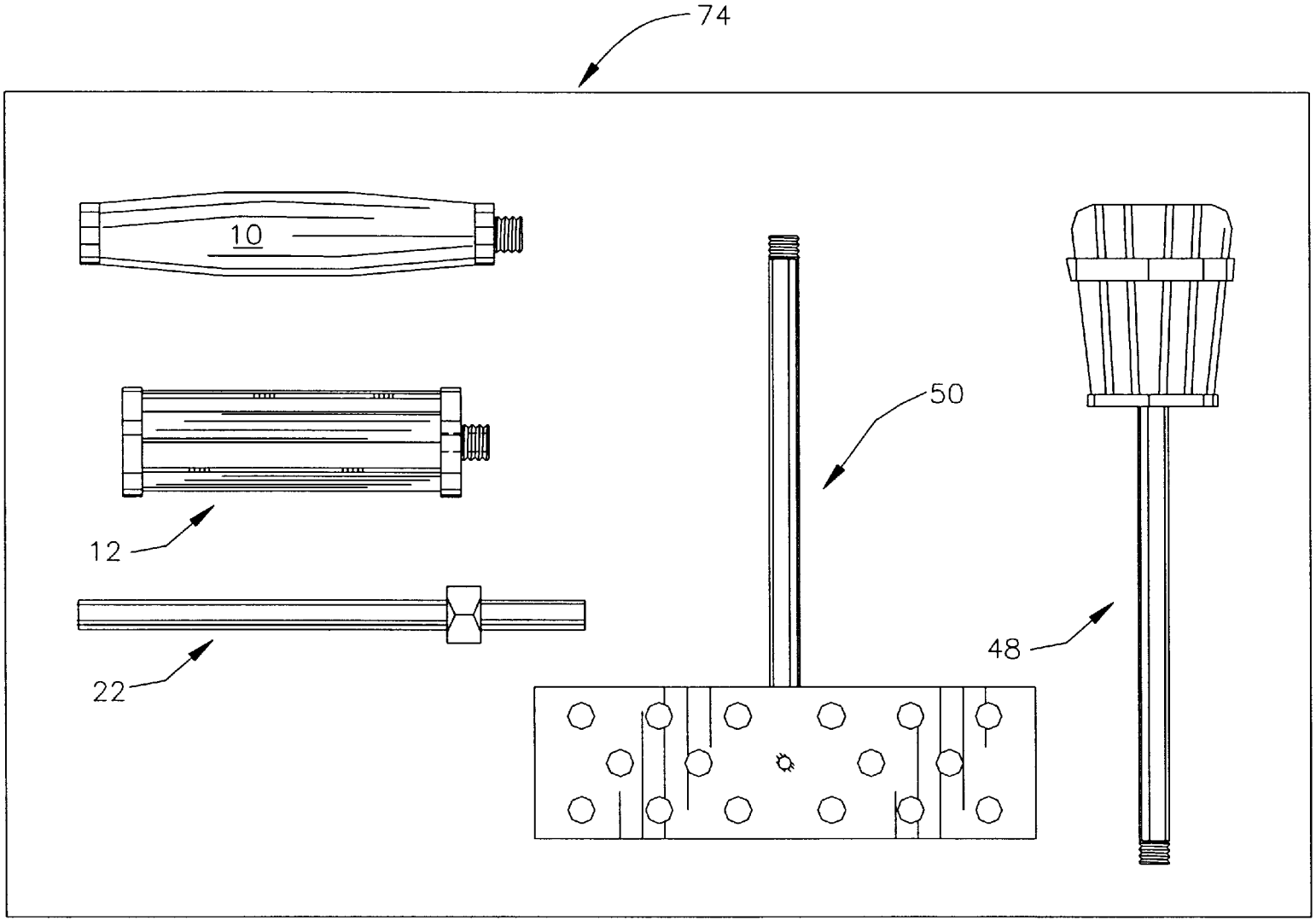
FIG. 5 is a plan view of a kit containing components shown in FIGS. 1, 3, and 4.

FIG. 5 illustrates a kit incorporating roller support member 10, mixer 12, drive element 22, brush holder 48, and paint mixer 50. The kit of FIG. 5 is enclosed within packaging 74. Packaging 74 may be corrugated paper, plastic, or any suitable material for containing the components of the kit or for retail displays of the kit.

The present invention is susceptible to variations and modifications which may be introduced thereto without departing from the inventive concept. For example, mixing element 66 may be removable from base shaft 64, rather than having rivet 70. Instead, mixing element 66 could be retained by friction in the two operative positions if desired. Also, the kit depicted in FIG. 5 may comprise fewer or additional components, if desired. The kit could include plural numbers of any one type of component. Preferably, the sizes of plural numbers of components differ, so that each component is usable with paint rollers and brushes of different dimensions.

It is to be understood that the present invention is not limited to the embodiments described above, but encompasses any and all embodiments within the scope of the following claims.

I claim:

1. A kit of implements for mixing paint and for cleaning paint brushes and paint rollers, comprising:

a drive element having an elongate shaft with a first end configured for engagement with a chuck of a hand drill for providing torque and a connector at a second end of said shaft for coupling to other of said implements;

a roller support member configured and dimensioned to occupy the hollow center of a paint roller, wherein said roller support member has an attachment element removably attachable to said connector of said drive element;

a paint brush holder having an elongate shaft engageable with the chuck of the hand drill and a resilient grasping member disposed to close resiliently over the handle of a paint brush;

paint mixing means, having a mixing element for using torque supplied via said drive element, for mixing paint, said mixing element formed of predetermined geometry to facilitate paint mixing; and packaging enclosing said drive element, said roller support member, said paint brush holder, and said paint mixing means, said paint mixing means further having coupling means for providing removable connection to said drive element.

2. The kit according to claim 1, wherein the mixing element of said paint mixing means comprises a cage wherein said mixing element has paddles oriented longitudinally relative to the axis of rotation of said paint, mixing means when said paint mixing means is connected to said drive element and said drive element is rotated by a hand drill.

3. The kit according to claim 2, wherein said roller support member and said paint mixing means are dimensioned and configured to engage paint rollers of different diameters.

4. The kit according to claim 1, wherein said mixing element, of said paint mixing means, comprises a perforated member having means for mounting selectively in a first position perpendicularly aligned relative to said drive element, whereby said perforated member serves as a paint mixer, and a second position longitudinally aligned relative to said drive element, wherein said mixing element serves as a support for holding a paint roller on a hand drill so that the paint roller can be spun and cleaned utilizing the hand drill.

5. A kit of implements for mixing paint and for cleaning paint brushes and paint rollers, comprising:

a drive element having an elongate shaft engageable with a chuck of a hand drill and a connector fixed to said shaft;

a roller support member configured and dimensioned to occupy the hollow center of a paint roller, wherein said roller support member has an attachment element removably attachable to said connector of said drive element;

a paint brush holder having an elongate shaft engageable with the chuck of the hand drill and a resilient grasping member disposed to close resiliently over the handle of a paint brush;

a paint mixer having an elongate base shaft and a mixing element anchored at said base shaft;

wherein said mixing element of said paint mixer comprises a perforated member having means for mounting selectively in a first position perpendicularly aligned relative to said base shaft, whereby said perforated member serves as a paint mixer, and a second position longitudinally aligned relative to said base shaft, wherein said mixing element serves as a support for holding a paint roller on a hand drill so that the paint roller can be spun and cleaned utilizing the hand drill; and packaging enclosing said drive element, said roller support member, said paint brush holder, and said paint mixer, wherein said roller support member and said perforated member of said paint mixer are dimensioned and configured to engage paint rollers of different diameters.

6. A kit of implements for mixing paint and for cleaning paint brushes and paint rollers, comprising:

a drive element having an elongate shaft with a first end configured for engagement with a chuck of a hand drill for providing torque, and a connector at a second end of said shaft for coupling to a paint mixer;

a roller support member configured and dimensioned to occupy the hollow center of a paint roller, wherein said roller support member has an attachment element removably attachable to said connector of said drive element;

a paint brush holder having an elongate shaft engageable with the chuck of the hand drill and a resilient grasping member disposed to close resiliently over the handle of a paint brush;

a first paint mixer having a mixing element which comprises a cage wherein said mixing element has paddles oriented longitudinally relative to the axis of rotation of said paint mixer when said paint mixer is connected to said drive element and said drive element is rotated by a hand drill, said first paint mixer having coupling means for removable mounting to said drive element;

a second paint mixer having a mixing element, said mixing element of said second paint mixer comprises a perforated member having means for selectively mounting, for selectively mounting said mixing element onto said drive element, in a first position perpendicularly aligned relative to said drive element, whereby said perforated member serves as a paint mixer, and a second position longitudinally aligned relative to said drive element, wherein said mixing element serves as a support for holding a paint roller on a hand drill so that the paint roller can be spun and cleaned utilizing the hand drill; and packaging enclosing said drive element, said roller support member, said paint brush holder, said first paint mixer and said second paint mixer.

7. The kit according to claim 6, wherein said second paint mixer further comprises a pivot adapted for removable coupling to said drive element.

8. The kit according to claim 7, wherein said mixing elements are dimensioned and configured to engage paint rollers of different diameters.

* * * * *